US011162497B2

(12) United States Patent
Brunvold et al.

(10) Patent No.: US 11,162,497 B2
(45) Date of Patent: Nov. 2, 2021

(54) SYSTEM FOR MOVING FLUID WITH OPPOSED AXIAL FORCES

(71) Applicant: OneSubsea IP UK Limited, London (GB)

(72) Inventors: Anders Brunvold, Bergen (NO); Daniel Tonning, Bergen (NO); Simon Kalgraff, Bergen (NO); Wiggo Silden, Bergen (NO)

(73) Assignee: ONESUBSEA IP UK LIMITED, London (GB)

( * ) Notice: Subject to any disclaimer, the term of this patent is extended or adjusted under 35 U.S.C. 154(b) by 231 days.

(21) Appl. No.: 15/810,322

(22) Filed: Nov. 13, 2017

(65) Prior Publication Data

US 2019/0145415 A1 May 16, 2019

(51) Int. Cl.
*F04D 13/12* (2006.01)
*F04D 3/00* (2006.01)
(Continued)

(52) U.S. Cl.
CPC ..... *F04D 13/12* (2013.01); *F04D 3/00* (2013.01); *F04D 7/00* (2013.01); *F04D 13/06* (2013.01);
(Continued)

(58) Field of Classification Search
CPC . F04D 1/003; F04D 1/006; F04D 3/00; F04D 5/001; F04D 13/08–10;
(Continued)

(56) References Cited

U.S. PATENT DOCUMENTS 693,946 A * 2/1902 Boyce ..... F01D 1/28 415/64
2,234,733 A * 3/1941 Jendrassik ..... F04D 19/024 415/65
(Continued)

FOREIGN PATENT DOCUMENTS

DE 858196 C 12/1952
WO 9927256 A1 6/1999
(Continued)

OTHER PUBLICATIONS

Extended European Search Report issued in European Patent Appl. No. 18206032.7 dated Jul. 22, 2019; 11 pages.

*Primary Examiner* — Alexander B Comley
(74) *Attorney, Agent, or Firm* — Eileen Pape

(57) ABSTRACT

A technique facilitates movement of fluids with reduced component loading by utilizing opposed axial forces. The system for moving fluid may be in the form of a gas compressor, liquid pump, or other device able to pump or otherwise move fluid from one location to another. According to an embodiment, the system includes rotor sections which are combined with pumping features. The rotor sections are disposed radially between corresponding inner and outer stator sections which may be powered to cause relative rotation of inner and outer rotor sections in opposite directions. The rotors and corresponding pumping features
(Continued)

are configured to move fluid in opposed axial directions toward an outlet section so as to balance axial forces and thus reduce component loading, e.g. thrust bearing loading.

20 Claims, 3 Drawing Sheets

(51) Int. Cl.

| | |
|---|---|
| ***F04D 29/18*** | (2006.01) |
| ***F04D 13/06*** | (2006.01) |
| ***F04D 29/046*** | (2006.01) |
| ***F04D 19/02*** | (2006.01) |
| ***F04D 29/041*** | (2006.01) |
| ***F04D 29/52*** | (2006.01) |
| ***F04D 29/64*** | (2006.01) |
| ***F04D 13/08*** | (2006.01) |
| ***F04D 29/56*** | (2006.01) |
| ***F04D 31/00*** | (2006.01) |
| ***F04D 13/10*** | (2006.01) |
| ***F04D 29/051*** | (2006.01) |
| ***F04D 7/00*** | (2006.01) |
| ***F04D 25/06*** | (2006.01) |

(52) U.S. Cl.
CPC ..... *F04D 13/086* (2013.01); *F04D 13/10* (2013.01); *F04D 19/024* (2013.01); *F04D 25/0686* (2013.01); *F04D 29/041* (2013.01); *F04D 29/046* (2013.01); *F04D 29/051* (2013.01); *F04D 29/181* (2013.01); *F04D 29/528* (2013.01); *F04D 29/566* (2013.01); *F04D 29/648* (2013.01); *F04D 31/00* (2013.01)

(58) Field of Classification Search
CPC ..... F04D 17/127; F04D 19/024; F04D 7/00; F04D 13/06; F04D 13/086; F04D 13/12; F04D 25/0613; F04D 25/064; F04D 25/0646; F04D 25/0686; F04D 29/041; F04D 29/046; F04D 29/051; F04D 29/181–183; F04D 31/00
USPC ..... 415/65, 68, 93, 97–100, 102; 417/354, 417/356, 365, 423.3, 423.7, 423.14
See application file for complete search history.

(56) References Cited

U.S. PATENT DOCUMENTS

| | | | | | |
|---|---|---|---|---|---|
| 2,318,990 | A * | 5/1943 | Doran | F01D 1/28 | 415/64 |
| 5,209,650 | A * | 5/1993 | Lemieux | F01D 15/10 | 384/115 |
| 5,417,544 | A * | 5/1995 | Mohn | F04D 1/003 | 415/64 |
| 5,923,111 | A * | 7/1999 | Eno | E21B 43/128 | 310/153 |
| 5,924,848 | A * | 7/1999 | Izraelev | A61M 1/1036 | 415/900 |
| 6,100,618 | A * | 8/2000 | Schoeb | F04D 1/006 | 310/90 |
| 6,206,659 | B1 * | 3/2001 | Izraelev | F04D 1/006 | 415/900 |
| 6,247,892 | B1 * | 6/2001 | Kazatchkov | F04D 3/00 | 415/68 |
| 6,547,539 | B2 * | 4/2003 | Izraelev | F04D 1/006 | 415/900 |
| 6,595,743 | B1 * | 7/2003 | Kazatchkov | F04D 3/00 | 415/170.1 |
| 7,074,018 | B2 * | 7/2006 | Chang | F04C 2/1073 | 417/356 |
| 9,127,679 | B2 * | 9/2015 | Van Dam | F04D 13/028 | |
| 9,476,427 | B2 * | 10/2016 | Torkildsen | F04D 25/0686 | |
| 2007/0273225 | A1 * | 11/2007 | Head | F04D 13/10 | 310/87 |
| 2014/0147243 | A1 * | 5/2014 | Torkildsen | F04D 25/0686 | 415/1 |
| 2014/0205475 | A1 * | 7/2014 | Dale | F04D 13/086 | 417/351 |
| 2015/0104328 | A1 * | 4/2015 | Babbitt | F03B 11/004 | 417/2 |
| 2016/0169231 | A1 | 6/2016 | Michelassi et al. | | |
| 2017/0306966 | A1 | 10/2017 | Valland et al. | | |

FOREIGN PATENT DOCUMENTS

| | | | | |
|---|---|---|---|---|
| WO | WO-03031823 | A1 * | 4/2003 | F04D 25/16 |
| WO | 2014083055 | A2 | 6/2014 | |
| WO | 2014083055 | A3 | 7/2014 | |
| WO | 2017021553 | A1 | 2/2017 | |

* cited by examiner

SYSTEM FOR MOVING FLUID WITH OPPOSED AXIAL FORCES

BACKGROUND

Hydrocarbon fluids such as natural gas and oil are obtained from a subterranean geologic formation, referred to as a reservoir, by drilling a well that penetrates the hydrocarbon-bearing geologic formation. In many types of land-based applications and subsea applications, the fluids are moved, e.g. pumped, from one location to another. Various types of systems for moving fluid are employed at subsea locations, subterranean locations, and land-based locations. For example, various types of compressors and pumps may be used to move gases, liquids, or mixed phase fluids to desired collection locations or other locations. The compressors and pumps each have a potential flow capacity which depends on factors such as fluid characteristics, relevant pressures, and available power. During operation of the pump/compressor substantial axial loads may be created and these loads can cause excessive wear. The loads also may cause an operator to reduce flow to a level below the potential flow capacity.

SUMMARY

In general, a system and methodology are provided for moving fluids with reduced component loading by utilizing opposed axial forces. The system for moving fluid may be in the form of a gas compressor, liquid pump, or other device able to pump or otherwise move fluid from one location to another. According to an embodiment, the system comprises rotor sections which are combined with pumping features. The rotor sections are disposed radially between corresponding inner and outer stator sections which may be powered to cause relative rotation of inner and outer rotor sections in opposite directions. The rotors and corresponding pumping features are configured to move fluid in opposed axial directions toward an outlet section so as to balance axial forces and thus reduce component loading, e.g. thrust bearing loading.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
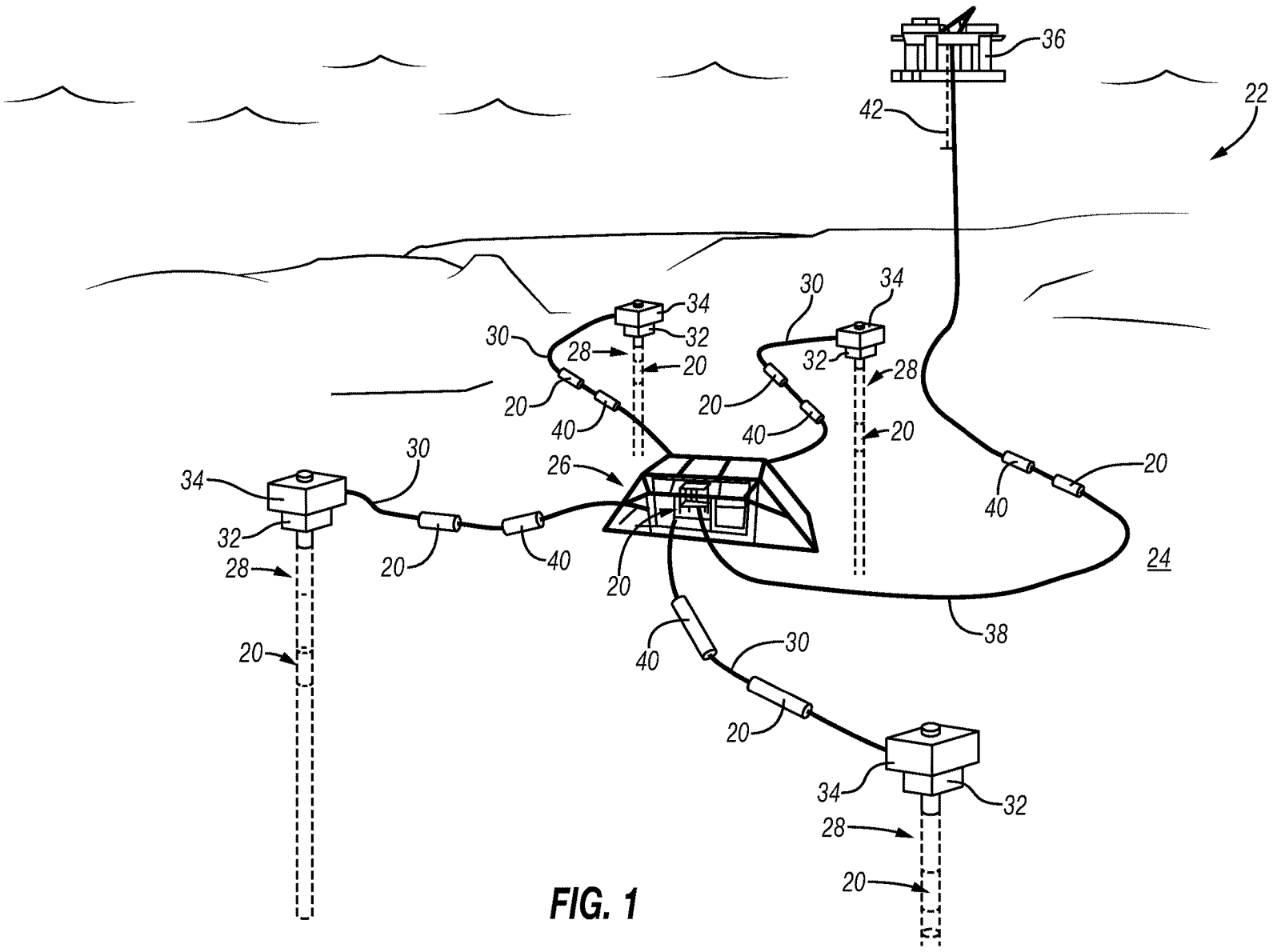
FIG. 1 is a schematic illustration of an example of a subsea system having fluid movement systems, e.g. compressors and/or other subsea pumping systems, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate movement of fluids. The fluid movement system may comprise various pumping systems, including liquid pumping systems and gas compressors, which provide reduced component loading by utilizing opposed axial forces. According to an embodiment, the system comprises rotor sections which are combined with pumping features. The rotor sections are disposed radially between corresponding inner and outer stator sections which may be powered to cause relative rotation of inner and outer rotor sections in opposite directions. The rotors and corresponding pumping features are configured to move fluid in opposed axial directions toward an outlet section so as to balance axial forces and thus reduce component loading, e.g. thrust bearing loading.

In some embodiments, the rotor sections may comprise permanent magnets combined with the radially inner and outer rotor sections. When electric power is supplied to the corresponding stator sections, the inner and outer rotor sections are counter rotated to provide the desired fluid movement, e.g. pumping of liquid, gas, or mixed phase fluid. Effectively, the stator sections are configured to generate rotating electromagnetic fields which interact with the corresponding rotor sections/permanent magnets to cause a desired rotation of the rotors about a central axis. For example, a torque may be transmitted to the rotors and combined pumping features by inducing electromagnetic forces which act on the permanent magnets of the rotors.

The pumping features are oriented to move fluid flows in generally opposite directions. For example, the pumping features may be oriented to move the fluid flows in a generally axial direction toward a center of the fluid movement system. A rotatable outlet section may be located between the first and second rotors to receive the axial fluid flows and to redirect those fluid flows in a generally radial direction to an outlet region of the fluid movement system, e.g. pumping system. In some embodiments, the pumping features may be oriented to move fluid in opposite axially outward directions.

This back-to-back combination of oppositely acting pumping features helps to balance axial forces or otherwise limit net axial forces acting in a single direction. Consequently, the fluid movement system can be constructed in a small size with relatively increased differential pressure capacity due to the increased unit power/capacity relative to unit size/weight. Some embodiments may be constructed with a mechanical seal less design which also enables flexibilities in product sizing.

An outer housing or casing may be disposed around the stator sections and rotor sections. According to some embodiments, the outer housing may be filled with a liquid which protects the internal components of the fluid movement system. The protective liquid and/or other features may be used to provide protection of rotors, stators, bearings, and other components when the fluid movement system is used in harsh environments, such as subsea environments or subterranean environments.

Referring generally to FIG. 1, examples of fluid movement systems 20 are illustrated at different locations within a subsea system 22. However, the fluid movement system or systems 20 may be used in a variety of other environments including surface environments, land-based environments, or other environments in which fluids are moved.

In the embodiment illustrated, various subsea components are deployed along a sea floor 24. For example, a subsea manifold 26 may be located downstream of a plurality of wells 28 used, for example, to produce hydrocarbon bearing fluid from a subterranean formation. The wells 28 are connected with the subsea manifold 26 by suitable flow lines 30, e.g. pipes. Hydrocarbon fluid may be produced up from wells 28 and through corresponding wellheads 32 and Christmas trees 34 and on to the subsea manifold 26 via flow lines 30.

From subsea manifold 26, the hydrocarbon bearing fluid may be routed to a surface facility 36, e.g. a surface platform or surface vessel, via a suitable flow line 38. The fluid movement systems 20 may be positioned at desired locations for facilitating fluid flow from wells 28 to surface facility 36. By way of example, the fluid movement systems 20 may be positioned in electric submersible pumping systems located within wells 28, e.g. within wellbores drilled into the subterranean formation.

Additional fluid movement systems 20, e.g. liquid pumps, multiphase pumps, gas compressors, may be positioned at other locations including within subsea manifold 26 and/or along flow line 38. In some applications, heating units 40 also may be positioned along the flow lines, e.g. along flow lines 30, 38. Electric power may be supplied to the fluid movement systems 20 and other subsea components, e.g. heating units 40, via a suitable power cable or cables 42 routed to the subsea locations from surface facility 36.

Figure 2:
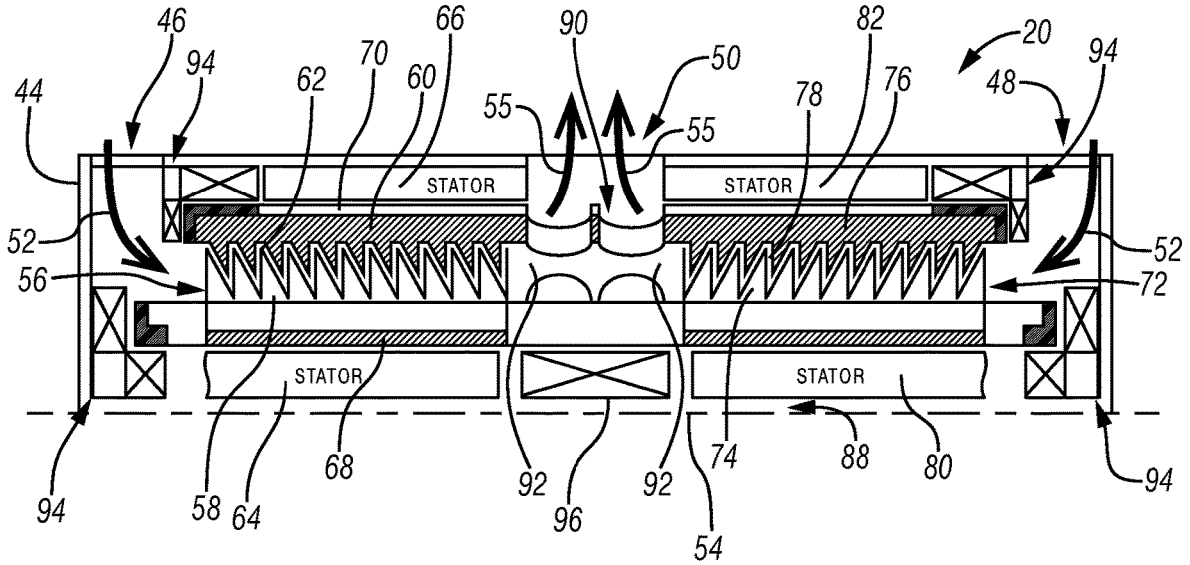
FIG. 2 is a schematic cross-sectional illustration of an example of a portion of a fluid movement system, according to an embodiment of the disclosure.

Referring generally to FIG. 2, an example of a fluid movement system 20 is illustrated and shows an upper half of the fluid movement system 20 in cross-section to facilitate explanation. In this embodiment, the fluid movement system 20 comprises an outer housing 44, e.g. an outer pump housing, having a first fluid inlet 46, a second fluid inlet 48, and an outlet region 50 disposed between the first inlet 46 and the second inlet 48. It should be noted that in some embodiments region 50 may serve as the fluid inlet and regions 46, 48 as fluid outlets. During operation of the illustrated fluid movement system 20, fluid is drawn in through inlets 46, 48 as indicated by arrows 52. In this embodiment, the flows of fluid enter housing 44 and then move axially generally in line with a system axis 54 until being discharged in a generally radial direction through outlet region 50 as indicated by arrows 55.

In the embodiment illustrated in FIG. 2, the system 20 further comprises a first rotor portion 56 having a first radially inner rotor section 58, a first radially outer rotor section 60, and first pumping features 62. The pumping features 62 may be in the form of impellers, vanes, or other suitable features constructed to move fluid from first inlet 46 to outlet 50.

The first rotor portion 56 is rotatably mounted within housing 44 between a first radially inner stator section 64 and a first radially outer stator section 66. The first rotor portion 56 also may comprise a first radially inward permanent magnet 68 coupled with inner rotor section 58 and a first radially outward permanent magnet 70 coupled with outer rotor section 60, as illustrated. The permanent magnets 68, 70 and the construction of separately rotatable inner rotor section 58 and outer rotor section 60 enable rotation of the inner rotor section 58 and outer rotor section 60 in opposite directions.

Similarly, the system 20 comprises a second rotor portion 72 having a second radially inner rotor section 74, a second radially outer rotor section 76, and second pumping features 78. The pumping features 78 may again be in the form of impellers, vanes, or other suitable features. The pumping features 78 are constructed to move fluid from second inlet 48 to outlet 50.

The second rotor portion 72 is rotatably mounted within housing 44 between a second radially inner stator section 80 and a second radially outer stator section 82. The second rotor portion 72 also may comprise a second radially inward permanent magnet 84 coupled with inner rotor section 74 and a second radially outward permanent magnet 86 coupled with outer rotor section 76, as illustrated. The permanent magnets 84, 86 and the construction of separately rotatable inner rotor section 80 and outer rotor section 82 enable rotation of the inner rotor section 80 and outer rotor section 82 in opposite directions. It should be noted the inner rotor sections 58, 74 may be rotated together as a single unit although some embodiments may use separate, independently rotatable rotor sections 58, 74. Similarly, the outer rotor sections 66, 76 may be rotated together as a single unit although some embodiments may use separate, independently rotatable rotor sections 60, 76. Regardless, the inner rotor sections may be counter rotated with respect to the outer rotor sections. It should be noted that labyrinth seals or other suitable seals may be employed between outer rotor sections 60, 76 and corresponding outer stator sections 66, 82 to prevent pressure losses through gaps therebetween.

When electric power is supplied to the stator sections 64, 66, 80, 82, the first and second rotor portions 56, 72 are rotated to provide the desired fluid movement, e.g. pumping of liquid, gas, or mixed phase fluid, via pumping features 62, 78. The stator sections 64, 66, 80, 82 generate rotating electromagnetic fields which interact with the corresponding rotor sections 58, 60, 74, 76 and corresponding permanent magnets 68, 70, 84, 86 to cause a desired rotation of the inner rotor sections 58, 74 relative to the outer rotor sections 60, 76 about the central system axis 54.

Figure 3:
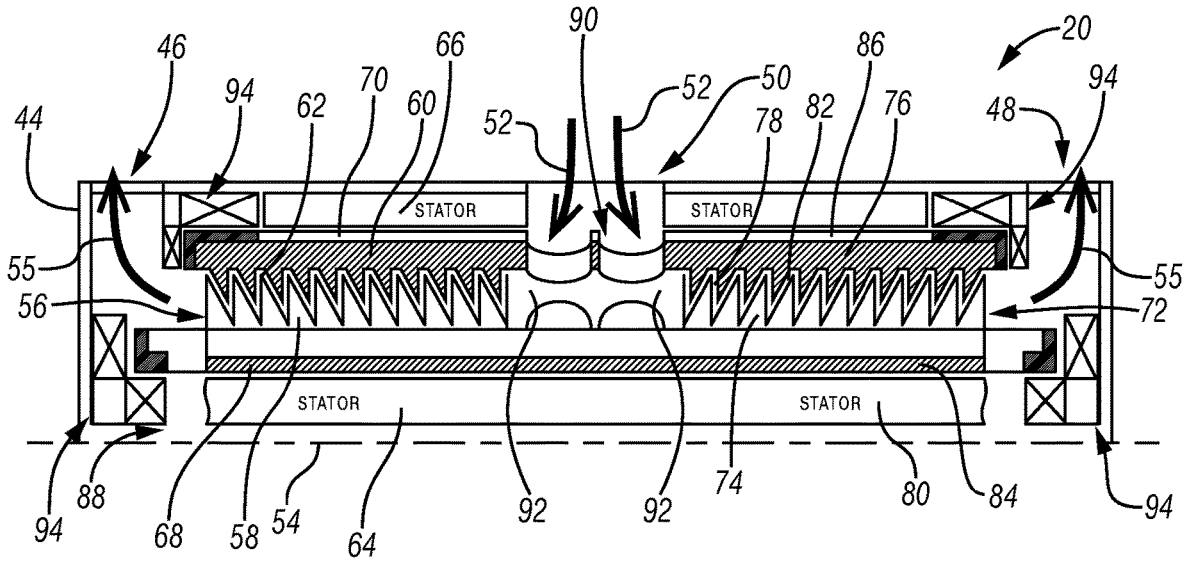
FIG. 3 is a schematic cross-sectional illustration of another example of a portion of a fluid movement system, according to an embodiment of the disclosure.

The pumping features 62, 78 may be oriented to move the fluid flows in axially opposed directions toward an axially central location during opposite rotation of inner rotor sections 58, 74 relative to outer rotor sections 60, 76. However, the pumping features 62, 78 also may be oriented to move the fluid flows in the axially opposed directions toward axially outlying regions when the rotor sections 58, 74 are counter rotated relative to rotor sections 60, 76. As illustrated in FIG. 3, the pumping features 62, 78 may be oriented to intake fluid through region 50 (as represented by arrows 52 in FIG. 3) and to discharge fluid at axially outlying regions 46, 48 (as represented by arrows 55 in FIG. 3). In some embodiments, a hollow passage 88, e.g. a flow passage, may extend through system 20 at a location radially within the first radially inner stator section 64 and the second radially inner stator section 80.

Referring again to the embodiment of FIG. 2, the fluid movement system 20 also may comprise a rotatable outlet section 90 located between the first rotor 56 and the second rotor 72. The rotatable outlet section 90 is constructed to rotate with inner and outer rotor sections of corresponding rotor portions 56, 72 and to receive the fluid flows from opposed directions. As described in greater detail below, the rotatable outlet section 90 receives the fluid flows moving in a generally axial direction and redirects the fluid flows to a generally radial direction for flow out through the outlet region 50 described in the embodiment of FIG. 2. The rotatable outlet section 90 may be constructed with cooperating sections 92 as illustrated. If the axial flow direction is reversed, as indicated in FIG. 3, the rotatable outlet section 90 may be omitted or moved to axially outlying regions 46, 48.

By way of example, the inner rotor sections 58, 74 and the outer rotor sections 60, 76 may be rotatably mounted within outer housing 44 via a plurality of radial and thrust bearing assemblies 94. The creation of opposed axial fluid flows, as described herein, reduces the thrust loading on thrust bearing assemblies 94 (and potentially on other components of fluid movement system 20) by producing counter acting axial thrust loads. In some embodiments, the first radially inner stator section 64 and the second radially inner stator section 74 may be separated by a central radial bearing 96. However, the first radially inner stator section 64 and second radially inner stator section 74 may be combined in a unitary structure, as illustrated in the embodiment of FIG. 3. In this latter embodiment, inner permanent magnet 68 and 84 also may be combined as a unitary structure as illustrated.

Figure 4:
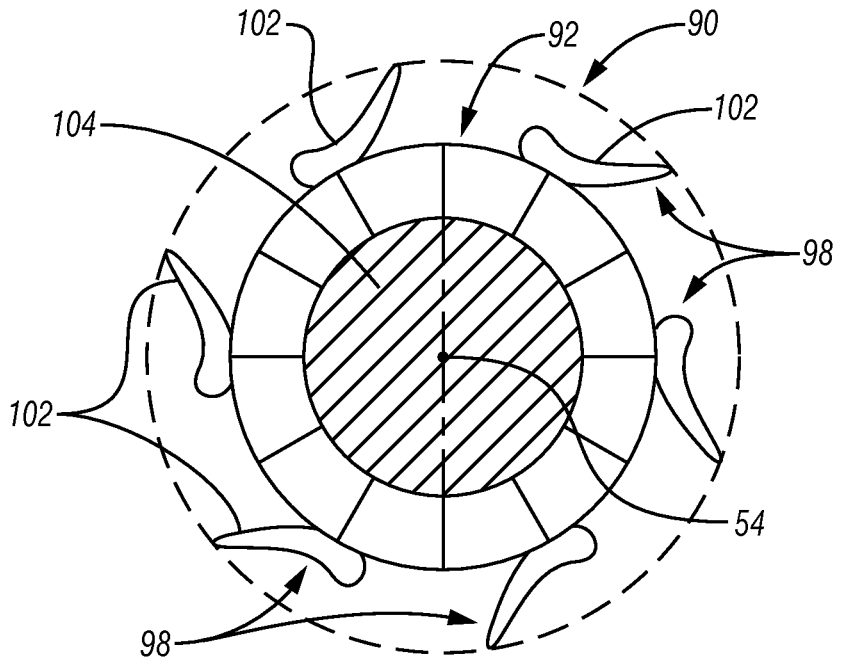
FIG. 4 is a cross-sectional illustration of an example of a rotatable outlet section which receives fluid flow from opposed directions and redirects the flows to a system outlet, according to an embodiment of the disclosure.
Figure 5:
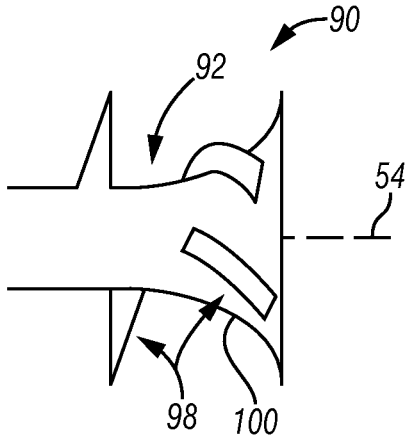
FIG. 5 is a side view of the rotatable outlet section illustrated in FIG. 4, according to an embodiment of the disclosure.

Referring generally to FIGS. 4 and 5, an illustration of rotatable outlet section 90 is provided. In this example, the rotatable outlet section 90 comprises flow members 98 disposed along the rotatable sections 92 in a position to receive the corresponding fluid flow moving in a generally axial direction and to redirect the fluid flow to a generally radial direction.

Additionally, the rotatable outlet section 90 may have an arcuate outer surface 100 which is shaped to guide the fluid flow from a generally axial flow to a generally radial flow so as to direct the flow of fluid out through outlet region 50 with less resistance. The flow members 98 also may comprise or may be constructed to pump or otherwise aid in moving the fluid flow received from the corresponding pumping features 62 or 78 until the fluid is discharged through outlet region 50. In some embodiments, the flow members 98 may be in the form of airfoils 102 which rotate with the corresponding rotor to facilitate the desired fluid movement out through region 50. Additionally, the rotatable component(s) 92 may be mounted on a corresponding rotor shaft or shafts 104 which also may be part of the corresponding rotor sections. The flow members 98 and arcuate surfaces 100 are examples of features which may be used to help make the fluid flow transition from relatively long axial flow paths to a radial outflow path.

Depending on the type of fluid being moved, the environment in which fluid movement system 20 is to be operated, and the desired volumetric flow rates, the fluid movement system 20 may be constructed in various sizes and configurations. The back-to-back configuration may be used in multiple types of pumps and compressors constructed for moving single phase fluids or multi-phase fluids.

In some embodiments, the inner and outer sections of rotors 56, 72 may be mounted on continuous rotatable shafts or on separate rotatable shaft segments which may be supported by suitable bearings, e.g. magnetic bearings, hydrodynamic bearings, and/or other suitable bearings. The bearings also may be selected according to the characteristics of the processed fluid and the intended duty.

The back-to-back construction enables the axial forces to be countered, e.g. axially balanced. To some extent, however, some axial thrust loading may be handled by thrust bearings. For example, there may be differences in composition of fluids entering the first inlet 46 relative to the second inlet 48 and these compositional differences can cause differences in axial forces even with the back-to-back construction. The radial and thrust bearing assemblies 94 may be selected to handle the anticipated radial and thrust loading.

Depending on the torque desired, different arrangements of radially inner and outer rotors, permanent magnets, and stator sections may be employed. In some embodiments, each rotor may be constructed with a single rotor section and corresponding permanent magnet for use in combination with a single corresponding stator section. Various types of vanes or other features may be combined with the rotors 56, 72.

Additionally, the stator sections may be process cooled or cooled by circulation of a dielectric fluid. For example, stator sections may be canned to provide an enclosed structure for dielectric fluid and/or for protection of internal components against corrosion, moisture, and erosion. The dielectric fluid and/or other materials, e.g. coated thin alloy steel, also may be selected to minimize eddy current losses.

In some embodiments, the outlet region 50 may comprise or may work in cooperation with restrictions constructed to limit losses from the outlet pressure side to the inlet pressure side. An example of such a restriction is a labyrinth seal. However, other types of restrictions may be used.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for moving fluid, comprising: a housing having at least one first port region and at least one second port region; and a plurality of pumping sections disposed inside the housing along a rotational axis and configured to operate independent from one another, wherein the plurality of pumping sections are axially separate from one another and extend along a plurality of different axial portions of the rotational axis, wherein the plurality of pumping sections are configured to flow a fluid through the housing generally parallel to the rotational axis between the at least one first port region and the at least one second port region in opposed axial directions along the rotational axis, wherein each pumping section of the plurality of pumping sections comprises: a stator portion having a radially inner stator section and a radially outer stator section; a rotor portion having a radially inner rotor section, a radially outer rotor section, and pumping features, wherein the radially inner and radially outer rotor sections and the pumping features of the rotor portion are rotatably mounted for rotation about the rotational axis, wherein the radially inner and radially outer rotor sections of the rotor portion are disposed radially between and axially overlapping with the radially inner stator section and the radially outer stator section of the stator portion along one of the plurality of different axial portions of the rotational axis, wherein the radially inner stator section and the radially outer stator section of the stator portion are configured to generate rotating electromagnetic fields to cause rotation of the radially inner and radially outer rotor sections of the rotor portion about the rotational axis; wherein the radially inner and radially outer rotor sections of the rotor portion are configured to counter rotate about the rotational axis within the housing to flow the fluid in one of the opposed axial directions along the rotational axis.

2. The system as recited in claim 1, wherein the at least ones first port region comprises a first inlet and a second inlet, and further wherein the at least one second port region comprises an outlet region disposed axially between the first inlet and the second inlet.

3. The system as recited in claim 1, wherein the at least one first port region comprises a central port disposed axially between first and second ports of the second port region, wherein the central port comprises a rotatable port section.

4. The system as recited in claim 1, wherein the at least one first port region comprises a first outlet and a second outlet, and further wherein the at least one second port region comprises an inlet region disposed axially between the first outlet and the second outlet.

5. The system as recited in claim 1, wherein each radially inner rotor section of the plurality of pumping sections comprises a first permanent magnet and each radially outer rotor section of the plurality of pumping sections comprises a second permanent magnet.

6. The system as recited in claim 1, wherein each radially inner rotor section of the plurality of pumping sections comprises a first magnet located at a radially inward position and each radially outer rotor section of the plurality of pumping sections comprises a second magnet located at a radially outward position.

7. The system as recited in claim 1, wherein the radially inner stator sections of the plurality of pumping sections are axially separated by a radial bearing.

8. The system as recited in claim 1, wherein the pumping features of adjacent rotor portions of the plurality of pumping sections are axially separated from one another along an axial gap having one or more ports of the at least one first port region.

9. The system as recited in claim 1, wherein the pumping features comprise an impeller.

10. A system, comprising: a pumping assembly having: a housing; a first rotor portion configured to rotate about a rotational axis, wherein the first rotor portion comprises a first radially inner rotor section and a first radially outer rotor section rotatably mounted in the housing radially between a first radially inward stator section and a first radially outward stator section relative to the rotational axis, wherein the first radially inner rotor section, the first radially outer rotor section, the first radially inward stator section, and the first radially outward stator section axially overlap with one another over a first axial portion of the rotational axis, wherein the first radially inward stator section and the first radially outward stator section are configured to generate rotating electromagnetic fields to cause rotation of the first radially inner and the first radially outer rotor sections about the rotational axis, wherein the first rotor portion is coupled with a rotatable outlet section and has first pumping features oriented to move fluid through the housing toward the rotatable outlet section in a first direction generally parallel with the rotational axis, and the first radially inner rotor section and the first radially outer rotor section being are rotatable about the rotational axis; and a second rotor portion separate from the first rotor portion and configured to rotate about the rotational axis, wherein the second rotor portion comprises a second radially inner rotor section and a second radially outer rotor section rotatably mounted in the housing radially between a second radially inward stator section and a second radially outward stator section relative to the rotational axis, wherein the second radially inner rotor section, the second radially outer rotor section, the second radially inward stator section, and the second radially outward stator section axially overlap with one another over a second axial portion of the rotational axis, wherein the first and second axial portions of the rotational axis are disposed on axially opposite sides of the rotatable outlet section relative to the rotational axis, wherein the second radially inward stator section and the second radially outward stator section are configured to generate rotating electromagnetic fields to cause rotation of the second radially inner and the second radially outer rotor sections, wherein the second rotor portion is coupled with the rotatable outlet section and has second pumping features oriented to move fluid through the housing toward the rotatable outlet section in a second direction generally parallel with the rotational axis, wherein the first and second directions are opposite from one another, and the second radially inner rotor section and the second radially outer rotor section are rotatable about the rotational axis; wherein the first and second radially inner rotor sections, the first and second radially outer rotor sections, the first and second radially inward stator sections and the first and second radially outward stator sections are arranged in the housing in a direction generally parallel to the rotational axis.

11. The system as recited in claim 10, wherein the rotatable outlet section comprises flow members to receive the fluid flows from a generally axial direction and to redirect the fluid flows to a generally radial direction for flow out through an outlet region.

12. The system as recited in claim 10, wherein the first radially inner rotor section is coupled with a first inner permanent magnet along at least part of the first axial portion of the rotational axis, and the first radially outer rotor section is coupled with a first outer permanent magnet along at least part of the first axial portion of the rotational axis.

13. The system as recited in claim 12, wherein the second radially inner rotor section is coupled with a second inner permanent magnet along at least part of the second axial portion of the rotational axis, and the second radially outer rotor section is coupled with a second outer permanent magnet along at least part of the second axial portion of the rotational axis.

14. The system as recited in claim 10, wherein each of the first pumping features and the second pumping features comprises an impeller.

15. The system as recited in claim 10, wherein the first radially inner stator section and the second radially inner stator section are axially separated by a radial bearing.

16. The system as recited in claim 10, wherein the first rotor portion and the second rotor portion are rotatably mounted in a plurality of radial and thrust bearing assemblies to enable counter rotation of the first and second radially inner rotor sections relative to the first and second radially outer rotor sections.

17. A method, comprising: mounting pumping features on first and second radially inner rotor sections and on first and second radially outer rotor sections; rotatably positioning the first and second radially inner rotor sections and the first and second radially outer rotor sections for rotation about a rotational axis and radially between respective first and second radially inner stator sections and respective first and second radially outer stator sections, the first and second radially inner stator sections and the first and second radially outer stator sections being configured to generate rotating electromagnetic fields to cause rotation of the first and second radially inner and radially outer rotor sections; and providing the pumping features with orientations which cause respective fluid flows in a housing in opposite axial directions along the rotational axis when the first and second radially inner rotor sections are counter rotated with respect to the first and second radially outer rotor sections under the influence of electromagnetic fields created via the first and second radially inner and outer stator sections; wherein the first and second radially inner rotor sections, the first and second radially outer rotor sections, the first and second radially inner stator sections and the first and second radially outer stator sections are arranged in the housing in a direction generally parallel to the rotational axis and the fluid flows; wherein the first radially inner rotor section, the first radially outer rotor section, the first radially inner stator section, and the first radially outer stator section axially overlap with one another over a first axial portion of the rotational axis to define a first fluid flow path between a first port and a second port; wherein the second radially inner rotor section, the second radially outer rotor section, the second radially inner stator section, and the second radially outer stator section axially overlap with one another over a second axial portion of the rotational axis to define a second fluid flow path between the first port and a third port; wherein the first and second axial portions of the rotational axis are disposed on axially opposite sides of the first port relative to the rotational axis, wherein the second and third ports are disposed on axially opposite sides of the first port relative to the rotational axis.

18. The method as recited in claim 17, further comprising coupling the first and second radially inner and radially outer rotor sections to a rotatable outlet section which redirects the respective fluid flows radially outward to an outlet region of the housing, wherein the first port comprises the rotatable outlet section.

19. The method as recited in claim 17, further comprising providing each of the first and second radially inner and radially outer rotor sections with permanent magnets.

20. The method as recited in claim 17, further comprising providing a hollow passage located radially within the first and second radially inner stator sections.

* * * * *